United States Patent [19]

Peddinghaus

[11] Patent Number: 4,501,507

[45] Date of Patent: Feb. 26, 1985

[54] HEAVY-DUTY SELECTIVE EMBOSSING APPARATUS

[76] Inventor: Rolf Peddinghaus, Deterbergerstr. 25, 5828 Ennepetal, Fed. Rep. of Germany

[21] Appl. No.: 549,206

[22] Filed: Nov. 4, 1983

[30] Foreign Application Priority Data

Nov. 5, 1982 [DE] Fed. Rep. of Germany ..... 3240858

[51] Int. Cl.[3] ..... B41J 1/32; B41J 3/38

[52] U.S. Cl. ..... 400/134; 101/4

[58] Field of Search ..... 101/3 R, 9–11, 101/18, 41, 44, 4; 400/134, 127, 128, 129, 130

[56] References Cited

U.S. PATENT DOCUMENTS

| | | | |
|---|---|---|---|
| 3,020,834 | 2/1962 | Brown et al. | 101/4 |
| 3,157,114 | 11/1964 | Halverson | 101/44 X |
| 3,941,050 | 3/1976 | Martindale | 101/44 X |
| 4,020,757 | 5/1977 | Christensen | 400/134 X |
| 4,214,520 | 7/1980 | Eissel | 400/134 X |
| 4,410,287 | 10/1983 | Speicher | 400/134 |
| 4,431,321 | 2/1984 | Trimble | 400/134 X |

FOREIGN PATENT DOCUMENTS

| | | | |
|---|---|---|---|
| 2340528 | 12/1975 | Fed. Rep. of Germany . | |
| 2653916 | 6/1978 | Fed. Rep. of Germany | 101/4 |
| 2728058 | 1/1979 | Fed. Rep. of Germany | 101/4 |
| 501800 | 4/1976 | U.S.S.R. | 101/4 |

*Primary Examiner*—Clifford D. Crowder

*Attorney, Agent, or Firm*—Karl F. Ross; Herbert Dubno

[57] ABSTRACT

An apparatus for embossing an imprint in a workpiece has a rigid frame having a front end to one side of the workpiece to be embossed and a rear end to the other side thereof. At least the front end of the frame can move relative to the workpiece in a longitudinal direction across the workpiece and between the front and rear frame ends. An anvil on the front frame end is engageable with the one side of the workpiece. A tool support on the rear end of the frame can move longitudinally relative to same and to the workpiece. A tool wheel rotatable on the tool support about a transverse tool axis generally perpendicular to the longitudinal direction has a periphery carrying a plurality of different embossing tools spaced angularly about the tool axis. This wheel is angularly displaceable through a plurality of respective positions in each of which a respective one of the tools longitudinally forwardly confronts the other side of the workpiece in line longitudinally with the anvil. An actuator is engaged backward against the rear end of the frame and is forwardly engageable with the tool wheel at a location thereon diametrally relative to the tool axis opposite the tool confronting the workpiece. Thus the actuator can expand longitudinally and pull the anvil back into engagement with the one side of the workpiece while pushing the wheel into engagement with the other side of the workpiece.

9 Claims, 5 Drawing Figures

HEAVY-DUTY SELECTIVE EMBOSSING APPARATUS

FIELD OF THE INVENTION

The present invention relates to a heavy-duty embossing apparatus. More particularly this invention concerns such an apparatus which can make an imprint in a steel beam or the like.

BACKGROUND OF THE INVENTION

A standard such apparatus normally has a rigid frame having a front end to one side of the workpiece to be embossed and a rear end to the other side thereof. An anvil on the front frame end is engageable with the one side of the workpiece and a tool is supported on the rear end of the frame for longitudinal movement relative to the workpiece. The tool is basically a punch of very hard metal that is pressed with sufficient force against the workpiece, which itself is braced against the anvil, that the workpiece plastifies and flows where engaged by the tool. The face of the tool bears raised indicia that are thus imprinted into the workpiece surface and that, for instance, identify the manufacturer.

In a standard such apparatus, as described in German Pat. No. 2,340,528 of E. Kruse, the tool is held in a chuck and can only be exchanged for a different one when the system is down. Thus it is necessary to provide all the necessary information on a single tool, which must be changed each time the run of a particular workpiece is complete.

OBJECTS OF THE INVENTION

It is therefore an object of the present invention to provide an improved embossing apparatus.

Another object is the provision of such an embossing apparatus which overcomes the above-given disadvantages, that is which can mark a workpiece in any of several different ways without shutting the system down to change tools.

SUMMARY OF THE INVENTION

An apparatus for embossing an imprint in a workpiece according to the invention has a rigid frame having a front end to one side of the workpiece to be embossed and a rear end to the other side thereof. At least the front end of the frame can move relative to the workpiece in a longitudinal direction across the workpiece and between the front and rear frame ends. An anvil on the front frame end is engageable with the one side of the workpiece. A tool support on the rear end of the frame can move longitudinally relative to same and to the workpiece. A tool wheel rotatable on the tool support about a transverse tool axis generally perpendicular to the longitudinal direction has a periphery carrying a plurality of tools spaced angularly about the tool axis. This wheel is angularly displaceable through a plurality of respective positions in each of which a respective one of the tools longitudinally forwardly confronts the other side of the workpiece in line longitudinally with the anvil. An actuator is engaged backward against the rear end of the frame and is forwardly engageable with the tool wheel at a location thereon diametrally relative to the tool axis opposite the tool confronting the workpiece. Thus the actuator can expand longitudinally and pull the anvil back into engagement with the one side of the workpiece while pushing the wheel into engagement with the other side of the workpiece.

It has been found that sufficient force can be transmitted diametrally through such a tool wheel to emboss steel plate and structural members. When the wheel carries a plurality of different tools capable of leaving different imprints embossed in the workpiece, it is therefore possible to reset it to emboss different things into the workpiece as it moves past the embossing apparatus or as the embossing apparatus moves along it, or at the least the apparatus can be reset to emboss different things on succeeding workpieces without having to stop production for the reset.

According to this invention a drive is provided on the tool support for rotating the tool wheel about the tool axis through the respective positions. The drive can be a motor and transmission for accurate angular positioning of the tool wheel. A digitally controlled stepping motor can ensure perfect tool position.

The longitudinal direction in accordance with this invention can be horizontal and the frame can be supported on horizontal guides. In addition the tools can be integral with and in fact machined into the wheel, or can be replaceable inserts. The latter system is particularly useful when an entire set of numbers and/or alphabet is carried on the tool wheel for printing whole messages on the workpiece, as in this application tool wear is considerable.

The frame of the system of this invention can be U-shaped and have one leg forming the front end and another leg forming part of the rear end. In this case the actuator is a hydraulic cylinder positioned longitudinally between the other leg of the U-shaped frame and the tool wheel.

It is particularly advantageous to mount the entire apparatus so it can be fitted over the edge of a workpiece. making the longitudinal guides vertically displaceable and/or pivotal about an upright axis gives the machine particular adaptability to differently shaped workpieces.

In addition it is possible for the longitudinal direction to be upright, with the frame supported on vertical guides. In this configuration the rear end lies above the front end and the frame is annular and the workpiece projects through it. The front frame end carrying the anvil is displaceable longitudinally relative to the front frame end. The drive for such an arrangement includes a rear cylinder longitudinally between the wheel and the rear frame end and a front cylinder longitudinally between the anvil and the front frame end.

DESCRIPTION OF THE DRAWING

The above and other features and advantages will become more readily apparent from the following, reference being made to the accompanying drawing in which.

SPECIFIC DESCRIPTION

Figure 1:
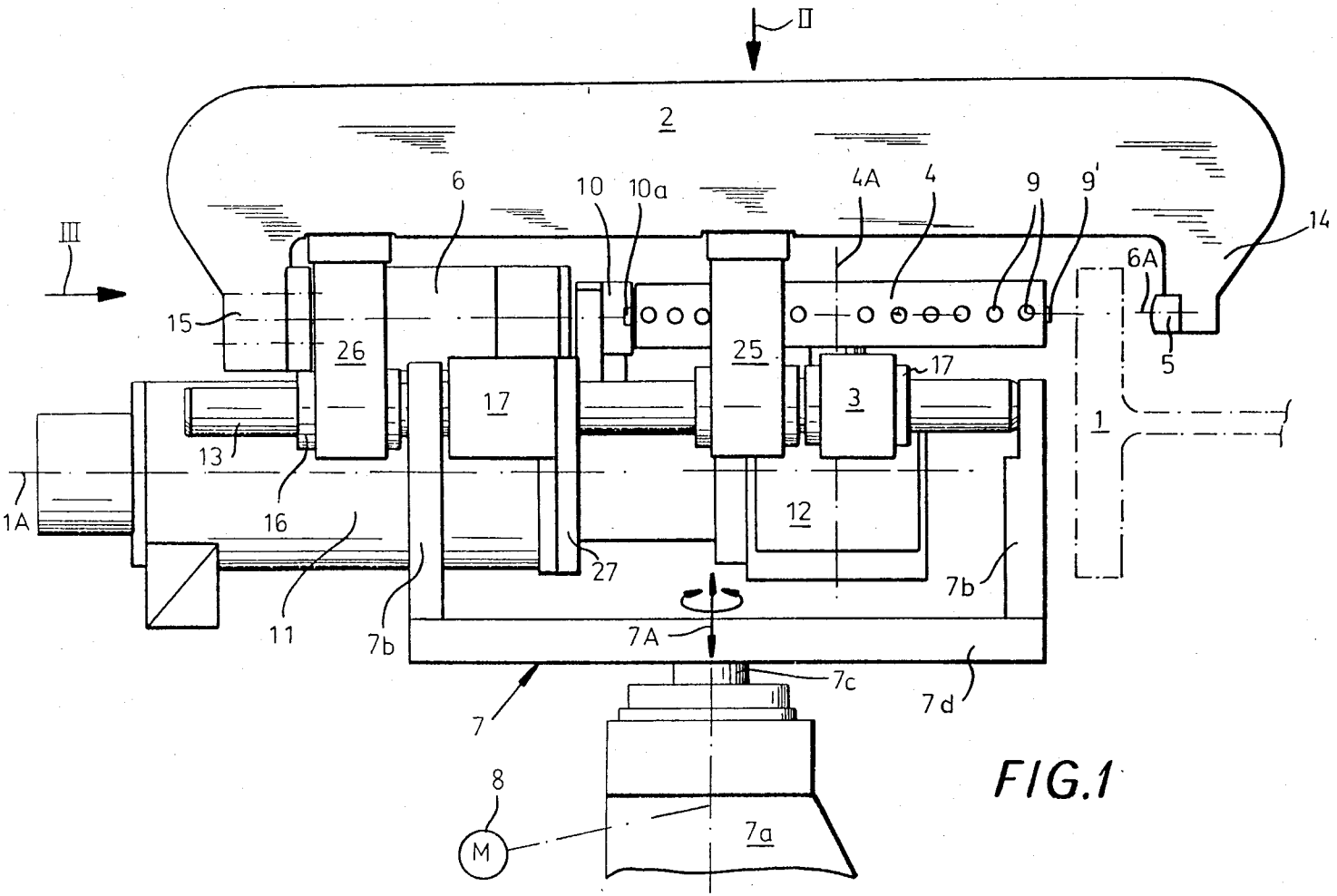
FIG. 1 is a side view of the apparatus according to this invention.
Figure 2:
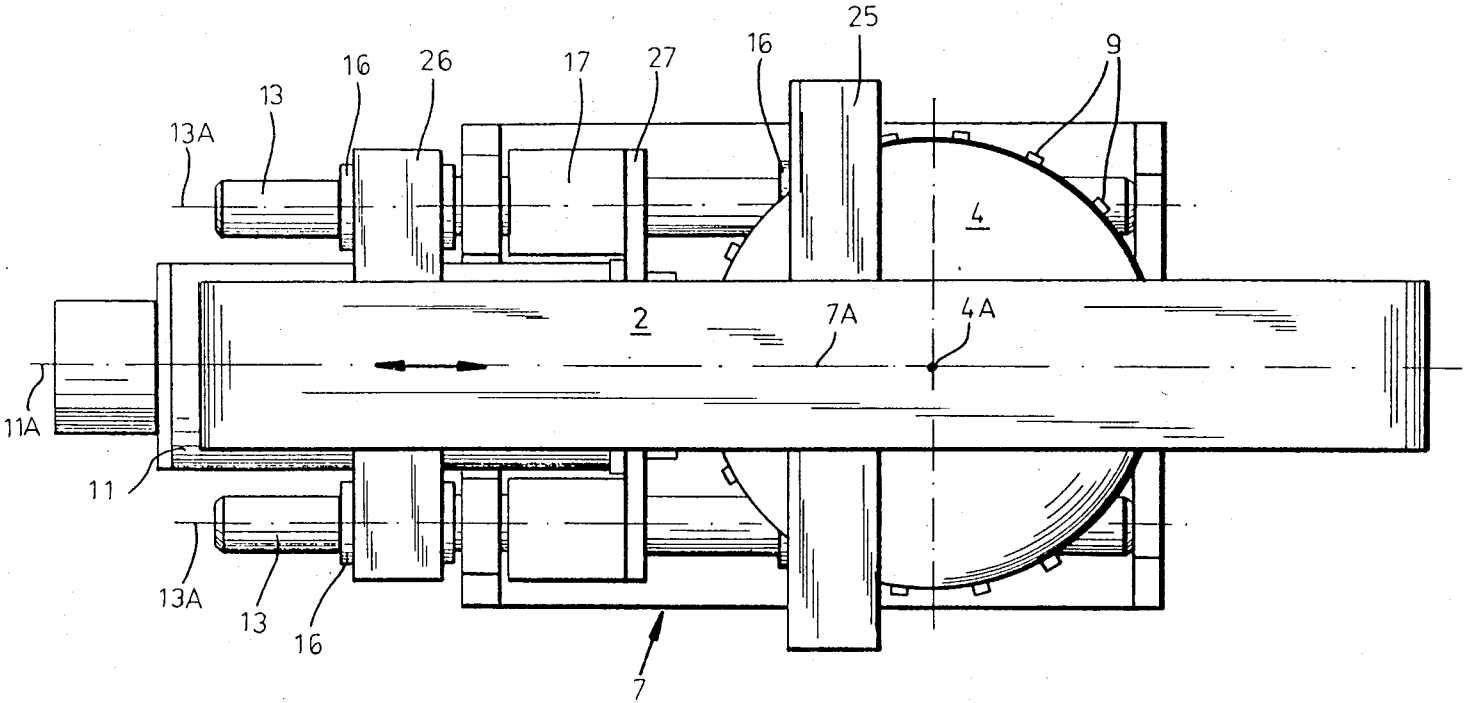
FIGS. 2 and 3 are top and end views taken in the direction of respective arrows II and III of FIG. 1.
Figure 3:
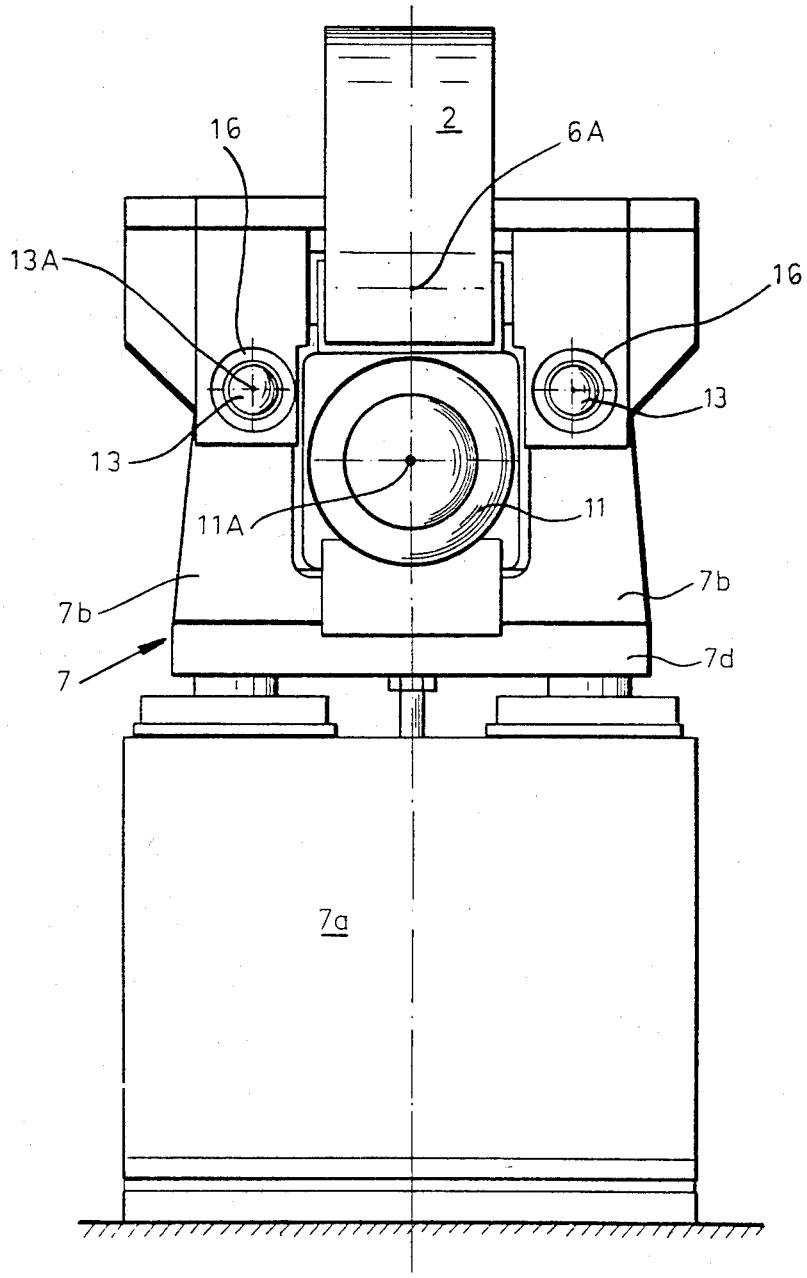

As seen in FIGS. 1, 2, and 3, the apparatus according to this invention, which here is shown embossing indicia on a flange of an I-beam workpiece 1, has a rigid frame or caliper 2 extending longitudinally. This frame 2 has a front end or arm 14 to one side of the workpiece 1 and a rear end or arm 15 to the other side thereof. The rear end 15 is secured to one end of a heavy-duty hydraulic actuating ram or cylinder 6 centered on an axis 6A extending longitudinally of the frame 2. The front end 14 carries a small anvil 5 also centered on the cylinder axis 6A.

A support 7 has a base *7a* provided with an upright shaft *7c* centered on an upright axis 7A perpendicular to and intersecting the axis 6A. This shaft *7c* carries a horizontal cross member *7d* having opposite ends that each support two respective posts *7b*. Two parallel support rods or guides 13 centered on axes 13A parallel to each other and lying in a plane perpendicular to the axis 7A extend horizontally between the arms *7b*. The support 7 includes a drive motor 8 that can raise and lower the guide rods 13 for movement along the upright axis 7A and angularly thereabout.

The frame 2 has two cross members 25 and 26 each carrying two bushings or sleeves 16 that ride on the rods 13. Thus the frame 2 can move limitedly parallel to the axes 13A and 6A on the support 7. The use of four such bushings 16 spaced axially and transversely ensures particularly smooth sliding of the frame assembly formed by the frame 2, anvil 5, cylinder 6, bushings 16, and crosspieces 25 and 26.

A tool wheel 4 centered on an upright axis 4A parallel to but offset toward the tool 1 from the axis 7A is rotatable on a tool support 3 having bushings 17 also slidable on the guide rods 13, but independently of the frame 2. A tool-drive motor 11 has a crosspiece 27 supported via similar bushings 17 on the rods 13 and is connected to a speed-reducing right-angle drive 12 whose output is rotatable about the axis 4A and carries the wheel 4. Thus the tool support 3, tool wheel 4, motor 11, transmission 12, bushings 17, and crosspiece 27 form a tool assembly all of whose parts move synchronously along the axes 13A, like the parts of the frame assembly 2, 5, 6, 16, 25, and 26 described above. These two assemblies move, however, independently of each other.

The tool axis 4A perpendicularly intersects the actuator axis 6A, and the tool wheel 4 is positioned between a pusher piece 10 carried by it and the workpiece 1. The wheel 4 carries on its cylindrical outer surface a plurality of angularly spaced embossing tools 9, which may be individual digits or preestablished numbers or codings, or even information relating to quality, manufacturer, type, or size of the workpiece 1.

In order to make an imprint on the workpiece 1, the drive motor 8 first positions the assembly so the workpiece part to be embossed is positioned between the anvil 5 and the wheel 4 with the region to be marked traversed by the axis 6A. The tool 9 which is to mark the workpiece 1 has meanwhile been brought into position in line along the axis 6A with the anvil 5, the diametrally opposite tool 9 axially confronting a recess 10*a* in the pusher piece 10, although it would be possible to employ an odd number of evenly spaced tools so the actuator would directly engage between tools, as there would be a space diametrally opposite each tool.

The actuator ram 6 is then expanded. Since the tool assembly 3, 4, 11, 12, 17, and 27 is substantially heavier than the frame assembly 2, 5, 6, 16, 25, and 26, this action first displaces the frame 2 relative to the tool wheel 4, sliding the bushings 16 on the rods 13 and pulling the anvil 5 longitudinally back into contact with the workpiece 1. Once the frame 2 is thus seated on the far face of the workpiece 1, continued axial expansion of the ram 6 will push the wheel 4, support 3, motor 11 and transmission 12 forward, and eventually will press the frontmost tool 9 against and into the workpiece 1, embossing it.

The ram 6 can be double acting so that once the embossing operation is complete it can push the anvil 5 forward out of engagement with the workpiece 1.

Figure 4:
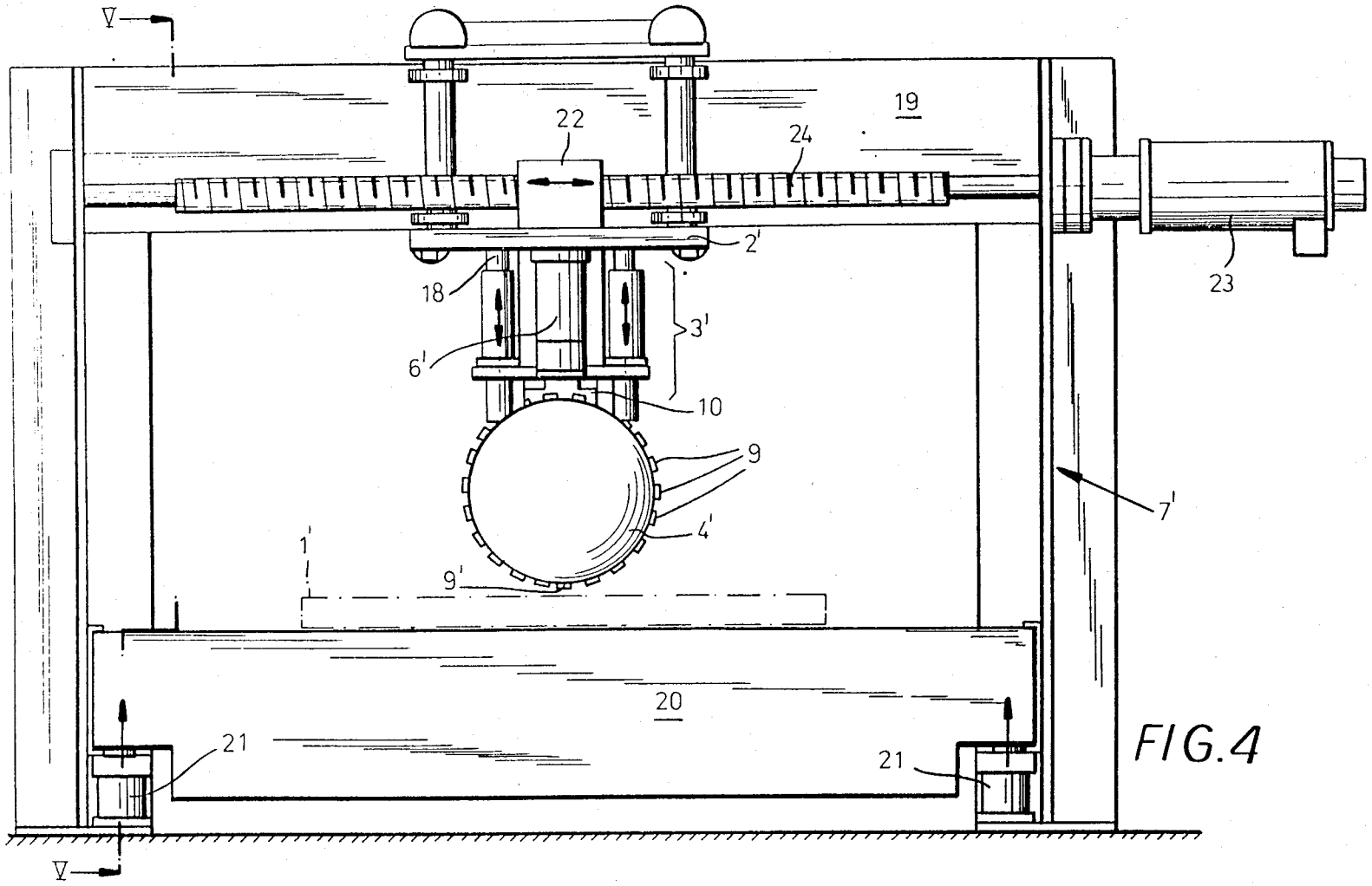
FIG. 4 is an end view of another apparatus in accordance with this invention.
Figure 5:
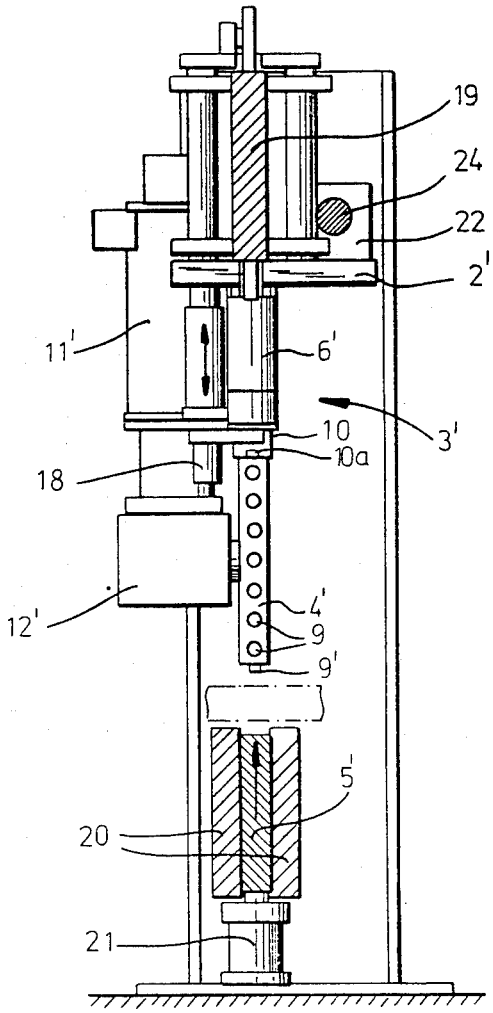
FIG. 5 is a vertical section taken along line V—V of FIG. 4.

In the arrangement of FIGS. 4 and 5 structure functionally identical to that of FIGS. 1 through 3 bears the same reference numerals with postscript primes. Here the tool support 3' rides on vertical guide rods 18 and is connected thereby to a carriage-like frame 2' which is horizontally displaceable on a horizontal upper portal beam 19 of the support 7' so it can be positioned over the workpiece 1'. An actuating ram 6' is also braced againt the frame 2'. The anvil 5' is underneath the tool wheel 4' in the frame 7' and can be lifted between workpiece support 20. Anvil cylinders 21 can thus lift this element 5' up into contact against the bottom face of the workpiece 1' resting on the supports 20.

The frame 2' is threaded at 22 to a spindle 24 connected to a drive 23 that therefore can position the tool wheel 4'. Both the support 20 and the anvil 5 extend over the entire length of travel of the tool wheel 4'.

In both arrangements the tool wheel can carry a great deal of separate tools so that in fact a workpiece can be marked at successive locations by different tools. In the arrangement of FIGS. 4 and 5, in particular, the drive 23 can displace the entire support frame 2' across the workpiece 1' while an appropriate digital controller angularly displaces the desired succession of tools 9 into position by operation of the stepping motor 11'. In fact automatic control makes it easy for successive workpieces to be marked with different imprints, all in accordance with relatively straightforward computer control.

It is furthermore not difficult to design the wheel so it can withstand the considerable forces needed for the embossing operation. Making the wheel basically of a disk of the same high-quality and tempered steel that is used to make a punch allows equally good strength to be obtained. The tools can normally be removably mounted on the wheel, to allow them to be replaced when worn out, an operation that is relatively simple.

I claim:

1. An apparatus for embossing an imprint in a workpiece, the apparatus comprising:

a rigid frame having a front end to one side of the workpiece to be embossed and a rear end to the other side thereof;

means supporting at least the front end of the frame for movement relative to the workpiece in a longitudinal direction which extends across the workpiece and between the front and rear frame ends;

an anvil on the front frame end and engageable with the one side of the workpiece;

a tool support;

means supporting the tool support on the frame for longitudinal movement relative to same and to the workpiece;

a tool wheel rotatable on the tool support about a transverse tool axis generally perpendicular to the longitudinal direction and having a periphery carrying a plurality of tools spaced angularly about the tool axis, the wheel being angularly displaceable through a plurality of respective positions in each of which a respective one of the tools longitudinally forwardly confronts the other side of the workpiece in line longitudinally with the anvil;

drive means on the tool support for rotating the tool wheel about the tool axis through the respective positions; and actuator means engaged backward against the rear end of the frame and engageable forwardly with the tool wheel at a location thereon diametrally relative to the tool axis opposite the tool confronting the workpiece, whereby the actuator means can expand longitudinally and pull the anvil back into engagement with the one side of the workpiece while pushing the wheel into engagement with the other side of the workpiece.

2. The embossing apparatus defined in claim 1 wherein the longitudinal direction is horizontal and the means supporting the frame includes horizontal guides.

3. The embossing apparatus defined in claim 1 wherein the frame is U-shaped and has one leg forming the front end, and another leg forming part of the rear end.

4. The embossing apparatus defined in claim 3 wherein the actuator means is a hydraulic cylinder positioned longitudinally between the other leg of the U-shaped frame and the tool wheel.

5. The embossing apparatus defined in claim 1 wherein the longitudinal direction is upright and the means supporting the frame includes vertical guides.

6. The embossing apparatus defined in claim 5 wherein the rear end lies above the front end.

7. The embossing apparatus defined in claim 5 wherein the frame is annular and the workpiece projects through it.

8. The embossing apparatus defined in claim 7 wherein the front frame end carrying the anvil is displaceable longitudinally relative to the front frame end.

9. The embossing apparatus defined in claim 8 wherein the drive means includes a rear cylinder longitudinally between the wheel and the rear frame end and a front cylinder longitudinally between the anvil and the front frame end.

* * * * *